United States Patent [19]

Shimazu et al.

[11] Patent Number: 4,611,143

[45] Date of Patent: Sep. 9, 1986

[54] COMPOSITE LIGHT SOURCE

[75] Inventors: Yuji Shimazu; Makoto Miyamoto, both of Hamamatsu, Japan

[73] Assignee: Hamamatsu Photonics Kabushiki Kaisha, Hamamatsu, Japan

[21] Appl. No.: 607,396

[22] Filed: May 3, 1984

[30] Foreign Application Priority Data

May 24, 1983 [JP] Japan ..... 58-90900

[51] Int. Cl.[4] ..... H01J 5/16; H01J 61/40; H01K 1/26

[52] U.S. Cl. ..... 313/111; 313/25; 313/580; 313/637

[58] Field of Search ..... 313/8, 111, 579, 580, 313/637, 609, 610, 619, 590; 315/49

[56] References Cited

U.S. PATENT DOCUMENTS 1,961,964 6/1934 Dodge ..... 313/111
2,064,252 12/1936 Fortney ..... 313/111
4,433,265 2/1984 Fischer et al. ..... 313/609

FOREIGN PATENT DOCUMENTS 8199 2/1980 Japan .
0288144 12/1970 U.S.S.R. ..... 313/610

*Primary Examiner*—David C. Nelms
*Assistant Examiner*—William L. Oen
*Attorney, Agent, or Firm*—Spencer & Frank

[57] ABSTRACT

An improved composite light source utilizing light from an arc discharge in a deuterium gas atmosphere and that from a tungsten lamp. The composite light source comprises a sealed envelope having a light emitting window made of quartz, in which deuterium gas is filled, an electrode structure to cause an arc discharge in the deuterium gas atmosphere to occur, and a tungsten lamp. The light emitting window, an aperture of a focusing plate for forming an arc discharge, an aperture of the anode, and the filament of the tungsten lamp are sequentially arranged in line at their centers. The composite light source has the optical means to focus the light beam emitted from the tungsten lamp onto the aperture of the focusing plate for forming the arc discharge. In the present invention, useless power consumption to elevate the temperature within the tungsten lamp can be reduced. It extends the life of the light source improving the efficiency of light emission.

6 Claims, 9 Drawing Figures

PRIOR ART

COMPOSITE LIGHT SOURCE

BACKGROUND OF THE INVENTION

The present invention relates to an improved light source which can emit in one direction a light beam composed of composite spectra from two types of light emitters enclosed within an envelope.

In Japanese Utility Model Registration No. 1,350,774 (Application No. 115714/1976), filed in the name of Hamamatsu TV Co., Ltd., this type of lamp was disclosed, and such a lamp has already been highly appreciated by the users.

Referring to FIGS. 1, 2 and 3, the configuration of this prior type of lamp will be described to provide a basis for explaining the problems which have been encountered in this type of lamp.

FIG. 1 shows a perspective view of a composite light source built in accordance with the above-referred to prior art.

FIG. 2 sshows a sectional view of the composite light source shown in FIG. 1.

FIG. 3 shows an enlarged sectional view of the main portion of the composite light source shown in FIGS. 1 and 2.

As shown in FIGS. 1 and 2, sealed envelope 1 is almost cylindrical and has a light emitting window 2 on a portion of the surface thereof.

Light emitting window 2 is made of quartz which does not absorb UV rays.

A shielding box 3 made of metal plates is located within sealed envelope 1. It is supported by a metal rod fastened to the stem at the bottom of sealed envelope 1 in the same manner as the electrodes.

The space enclosed within shielding box 3 is divided into a plurality of sub-spaces by separation walls made of metal plates, as shown in FIG. 2, and aperture 9 is provided for emitting light onto the surface located against the quartz window 2. Cathode 4 is provided on the upper side of the first space wherein the aperture 9 is provided. Cathode 4 is cylindrical, and within it a heater is formed.

An anode having an aperture 7 is provided at the center in the second space of the shielding box 3.

A wall separating the second space from the first space extends to the anode 5, and aperture 8 with a small diameter is provided at the top thereof.

A tungsten lamp 6 having a filament 10 is provided in the third space.

An aperture 23 is provided on the wall separating the third space from the second space.

Light emitting window 2 made of quartz, aperture 9 in shielding box 3, aperture 8, aperturre 7 of anode 5, and filament 10 are sequentially arranged in line at their centers.

Deuterium gas is introduced into sealed envelope 1 with light emitting window 2 made of quartz.

An appropriate voltage is applied to anode 5 with respect to cathode 4. An arc discharge occurring in the deuterium gas atmosphere can partly pass through the narrow channel formed by the aperture 8, and this causes a bright spot to occur in an area near aperture 8. When power is supplied to the tungsten lamp 6, filament 10 is brightened at high brightness and the energy component arriving at the aperture 8, among those emitted from filament 10, is projected in the forward direction.

One of the following three types of light sources can be obtained by simultaneously or selectively specifying light from an arc discharge occurring in the deuterium gas atmosphere or light from the tungsten lamp 6.

(1) Light source with a spectra covering the 190 nm to 3000 nm range, (2) Light source providing a UV ray (due to an arc discharge in the deuterium gas atmosphere) with the main energy covering the 190 nm to 390 nm range, (3) Light source (by tungsten lamp) emitting visible and infra red rays.

The light source in the above-mentioned structure can be used to obtain a bright spot emitting visible and infra red rays as well as UV rays from an arc discharge. The tungsten lamp thus emits light at very low efficiency in the above-mentioned lamp.

Part of the energy emitted from filament 10, which is not limited by aperture 8, can be used as a light source but that which is limited by the aperture cannot be used. Excessive power is required to heat filament 10 within tungsten lamp 6 if the same amount of energy as that obtained by the light source (1) utilizing an arc discharge is required. Part of the energy obtained by filament 10, for instance, 10 to 30 watts remain in the lamp and it elevates the filament temperature.

Tungsten lamp 6 is housed within sealed envelope 1 and energy stored in filament 10 cannot easily be removed. This elevates the temperature within sealed envelope 1. If the tungsten lamp 6 is continuously used for a long period of time, the temperature of anode 5 becomes several hundred degrees Celsius. Electrons striking anode 5 under those conditions can evaporate anode surface materials. Tungsten lamp 6 is located near anode 5 so as to increase the efficient with which the light beam is utilized. The evaporated materials can easily be deposited onto the transparent side wall within tungsten lamp 6 thereby making the side wall opaque. The evaporated materials can easily be deposited onto window 2 made of quartz, and this makes the window opaque. The radiation intensity obtained by tungsten lamp 6 thus decreases with time as shown in curve a of FIG. 8.

The objective of the present invention is to provide an improved composite light source which can eliminate variations in the light intensity with time.

SUMMARY OF THE INVENTION

The composite light source improved to accomplish the objective of the present invention is composed of a sealed envelope having a light emitting window made of quartz, wherein deuterium gas is introduced, an electrode structure to cause an arc discharge in the deuterium gas atmosphere to occur, which consists of a thermal cathode housed in the envelope, an anode having an aperture, and a focusing plate having an aperture of a small diameter which constitutes a path for forming an arc discharge, and a tungsten lamp sealed within the envelope. The light emitting window made of quartz, an aperture of a focusing plate which constitutes a path for forming an arc discharge, an aperture of the anode, and the filament of the tungsten lamp are sequentially arranged in line at their centers. Light emitted from an arc discharge of deuterium and/or that from the tungsten lamp can simultaneously or selectively be obtained by the composite light source of this type. The composite light source has, within the sealed envelope, the opical means to focus the light beam emitted from the tungsten lamp onto the aperture of the focusing plate for forming the path for an arc discharge. In accordance with the structure of the present invention, useless power consumption to elevate the temperature within the tungsten lamp can be reduced. It improves the efficiency of light emission, and extends the life of the light source.

DESCRIPTION OF THE PREFERRED EMBODIMENTS

Figure 4A:
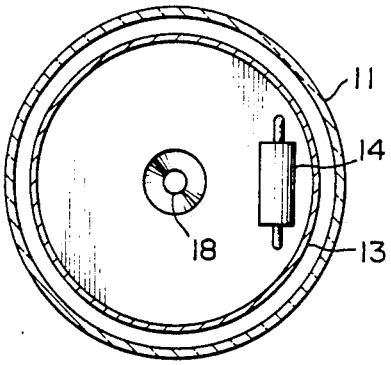
FIG. 4A shows a sectional view of a first embodiment of the composite light source built in accordance with the present invention when the lamp is cut along a plane including the tube axis and FIG. 4B a view along the plane defined by A—A.
Figure 4B:
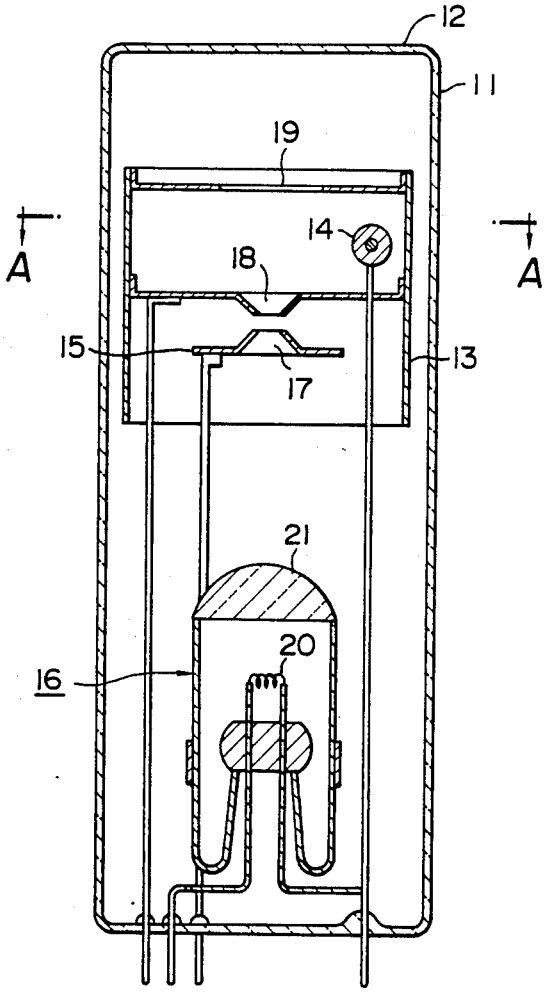

An improved composite light source, shown in FIGS. 4A and 4B, is one of the light sources which can project light in the direction of the tube axis.

Light emitting window 12 made of quartz is located at the top of sealed cylindrical envelope 11 made of glass.

Deuterium gas at a pressure on the order of several torrs is introduced into the sealed cylindrical envelope 11 made of glass.

Shielding box 13 of cylindrical shape and having an aperture 19 is provided within the sealed envelope 11.

A space enclosed within the shielding box 13 is divided by a wall having an aperture 18 at its center. Cathode 14 for use in obtaining an arc discharge is located at the upper side of the space enclosed within shielding box 13, and anode 15 for use in obtaining an arc discharge is located at the lower side of this space.

Thermal electron emission materials are coated on the surface of cylindrical cathode 14, and a heater is inserted into the cylinder of cathode 14.

Aperture 17 of the anode, which can pass the light beam from tungsten lamp 16 to be described later, is formed at the center of planar anode 15.

Tungsten lamp 16 is located beneath the shielding box 13 within sealed cylindrical envelope 11. Tungsten filament 20 whose length is shorter than that of tungsten filament 10 for the prior art composite light source is housed within the envelope for tungsten lamp 16.

Part of the sealed envelope for tungsten lamp 16 forms a convex lens 21. Tungsten lamp 16 is supported so that the axes of the convex lens 21 and tungsten filament 20 coincide with the tube axis for sealed cylindrical envelope 11.

The result is that the window 12 made of quartz, aperture 18 on the separation wall, aperture 17 within anode 15, convex lens 21 formed by the sealed envelope for tungsten lamp 16, and filament 20 for tungsten lamp 16 are sequentially arranged in line at their centers.

Tungsten lamp 16 is fastened so that an image of filament 20 is focused onto aperture 18 on the separation wall by means of the convex lens 21. One of the metal rods used to support filament 20, which is used as a lead for filament 20, is fastened at one end to the other metal rod used to support the heater for the cathode 14, which is used as another lead for the heater, and these leads are fastened to the stem of the sealed cylindrical envelope 11. The other metal rod used to support filament 20, which is used as another lead for filament 20, is fastened at one end to the stem.

If the heater of cathode 14 for the composite light source is powered when a DC voltage of 350 volts is fed through an external resistor to anode 15 with respect to cathode 14, an arc discharge in the deuterium gas atmosphere can occur in the space between the cathode 14 and anode 15.

The electron beam which has occurred in the path for the arc discharge can pass through aperture 18 formed on the separation wall of shielding box 13, and thus a bright spot can be formed at the location of the aperture due to an arc discharge in the deuterium gas atmosphere.

When current flows through tungsten filament 20 of tungsten lamp 16, tungsten filament 20 is heated at such a temperature that the tungsten filament 20 can emit a visible ray.

In the present embodiment, a voltage of five volts is supplied to filament 20 so as to cause a filament current of one ampere to flow.

The emitted light is focused on aperture 17 within anode 15 by means of convex lens 21.

Figure 5:
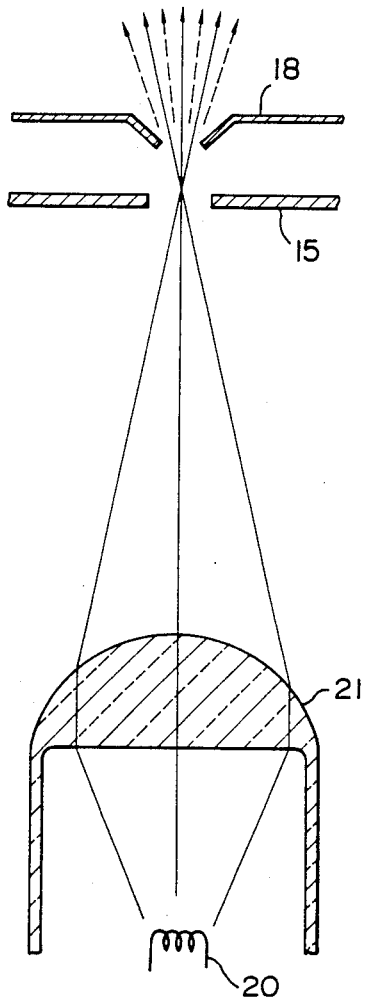
FIG. 5 outlines the path of light emitted from the composite light source built in accordance with the present invention.

Light emitted from tungsten filament 20, when arriving at convex lens 21, is focused on aperture 18 by means of convex lens 21 as shown in FIG. 5.

Focusing is carried out due to the following two reasons:

First, the size of the light beam spot at the aperture must be minimized to obtain the maximum light energy density which can pass through the light emitting window from tungsten lamp 16.

Second, light emitted from tungsten lamp 16 must be focused on the same location recognized as the spot light source, with high intensity, formed by an arc discharge in the deuterium gas atmosphere.

Accordingly, the light beam emitted from the arc discharge in the deuterium gas atmosphere and that emitted from tungsten lamp 16 are recognized as those emitted from the devices installed in the same location. Both light beams become a parallel beam when passing through a condenser lens.

The broken lines in FIG. 5 indicate light emitted from a bright spot formed by the arc discharge in the deuterium gas atmosphere.

Light emitted from tungsten lamp 16, shown in FIG. 5, is focused by means of convex lens 21 onto the location wherein a bright spot is formed by an arc discharge in the deuterium gas atmosphere.

Figure 7:
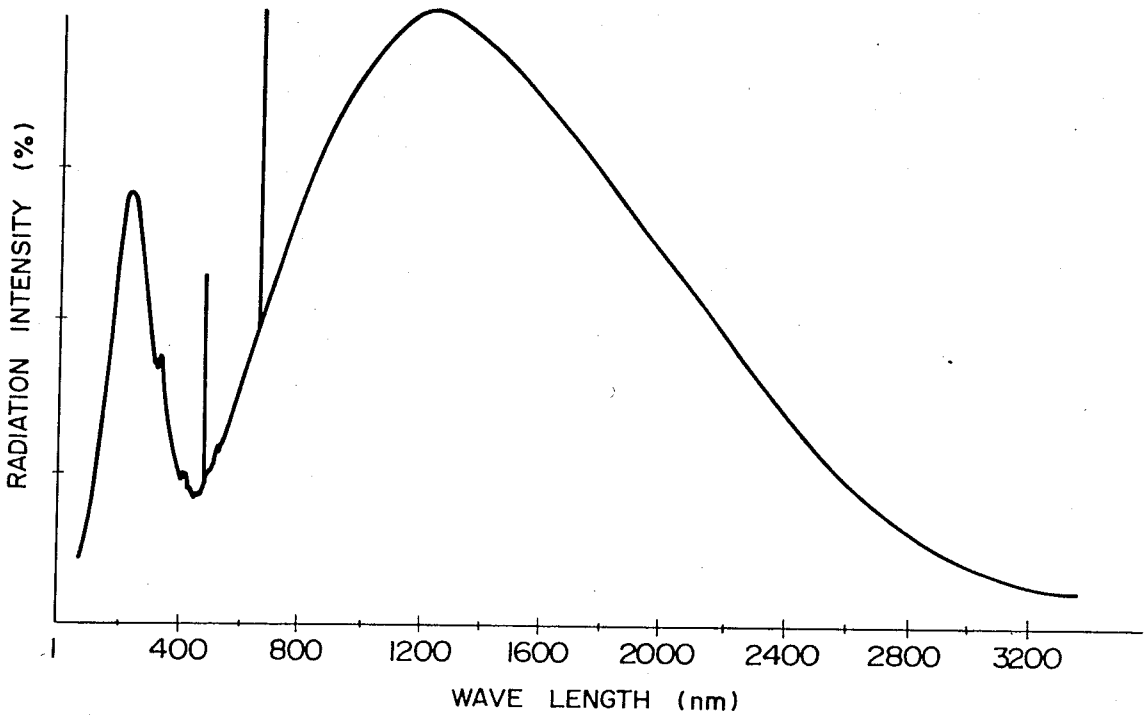
FIG. 7 is a graph showing the spectral response for the composite light source built in accordance with the present invention.

FIG. 7 shows the spectral response for both the light beam obtained by an arc discharge in the deuterium gas atmosphere and the light beam emitted from tungsten lamp 16.

The spectral response shown in FIG. 7 covers the 190 to 3000 nm range.

When a diffraction grating is arranged on the optical axis of the emitted light beam, the resulting contiguous spectrum covers the range of 190 nm in the UV region caused by deuterium to 3000 nm in the infra red region caused by tungsten lamp 16.

Spikes occurring in the positions covering the 400 to 600 nm range are caused by the bright line spectrum obtained by an arc discharge in the deuterium gas atmosphere.

Figure 6:
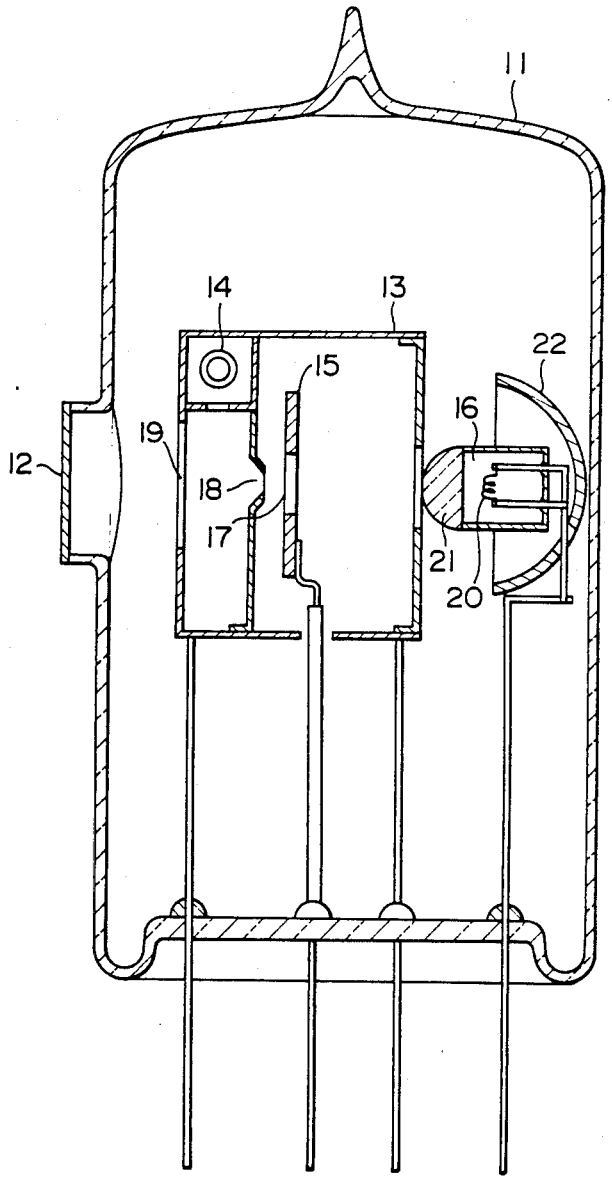
FIG. 6 shows a sectional view of a second embodiment of the composite light source built in accordance with the present invention when the lamp is cut along a plane including the tube axis.

FIG. 6 shows a sectional view of the second embodiment of the composite light source built in accordance with the present invention.

In this embodiment, a stem is provided at the bottom of the envelope so that the light source can emit light in the direction perpendicular to the tube axis.

Sealed envelope 11 is almost cylindrical, and light emitting window 12 is provided in a part of the surface thereof. Light emitting window 12 is made of quartz because quartz does not absorb UV rays.

Shielding box 13 made of metal plates is provided within sealed envelope 11. Shielding box 13 is supported by metal rods fastened to the stem at the bottom of sealed envelope 11 in the same manner that electrodes are fastened to the stem.

A space enclosed within shielding box 13 is divided into a plurality of sub-spaces by means of metal plates forming separation walls. Aperture 19 for use in light emission is provided on the surface facing the window 12 made of quartz. Cathode 14 is provided on the upper side of the first space wherein the aperture 19 is provided. Cathode 14 is a cylindrical and a heater is provided within cathode 14.

Anode 15 having aperture 17 at its center is arranged in the second space of shielding box 13.

The wall separating the second space from the first space, extending to the anode 15, provides an aperture 18 with a small diameter at its top. This structure is the same as that found in the already mentioned conventional art.

Tungsten lamp 16 is arranged behind the shielding box 13 within sealed cylindrical envelope 11 made of glass. The sealed envelope of tungsten lamp 16 partly forms convex lens 21.

Concave mirror 22 arranged behind tungsten lamp 16 reflects light emitted behind tungsten filament 20 to the tungsten filament 20 so as to obtain as great a quantity of light in the form of a beam as possible at the location of the convex lens 21. The window 12 made of quartz, aperture 18 on the separation wall, aperture 17 within anode 15, convex lens 21 arranged in the sealed glass envelope of tungsten lamp 16, filament 20 of tungsten lamp 16, and concave mirror 22 are sequentially arranged in line at their centers in the direction perpendicular to the tube axis.

A light source of this type can be operated in the same manner as the first embodiment of this invention. In this embodiment, the necessary light beam can be obtained with less power than that which is required for tungsten filament 20 in the first embodiment.

The light source built in accordance with the present invention emits a light beam focused onto an aperture from filament 20, and thus it can be operated with less filament power than that required for the light source built using the conventional technique.

Figure 1:
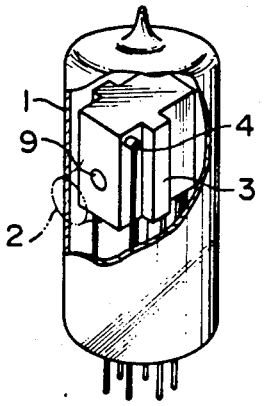
FIG. 1 shows a perspective view of the composite light source built in the above-referred to prior art.
Figure 2:
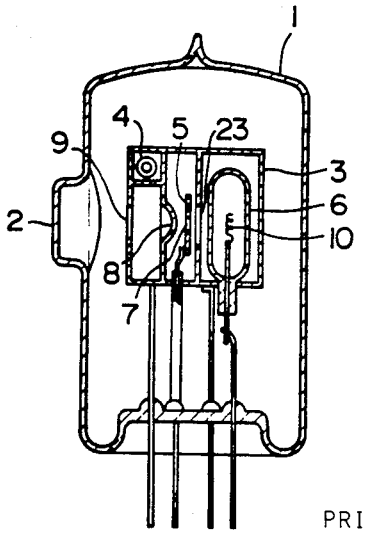
PRIOR ART FIG. 2
FIG. 2 shows a sectional view of the composite light source shown in FIG. 1.
Figure 3:
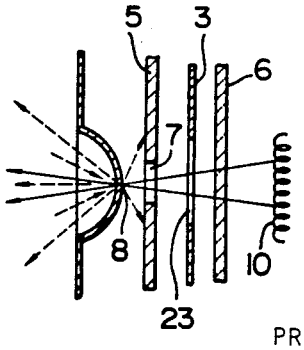
PRIOR ART FIG. 3
FIG. 3 shows an enlarged sectional view of the main portion of the composite light source shown in FIGS. 1 and 2.

The device of the first embodiment can emit the same quantity of light in the form of a beam using 1/10 the filament power required for the light source shown in FIG. 1.

The device of the second embodiment must emit the same quantity of light in the form of a beam when less power than that required for the first embodiment is supplied to the filament.

This results in a lower temperature rise within the tube than that of the conventional lamp. This lower temperature rise protects the materials forming the anode against evaporation while evaporation can be seen in the tube of the conventional art, and it keeps the light beam energy unchanged.

Figure 8:
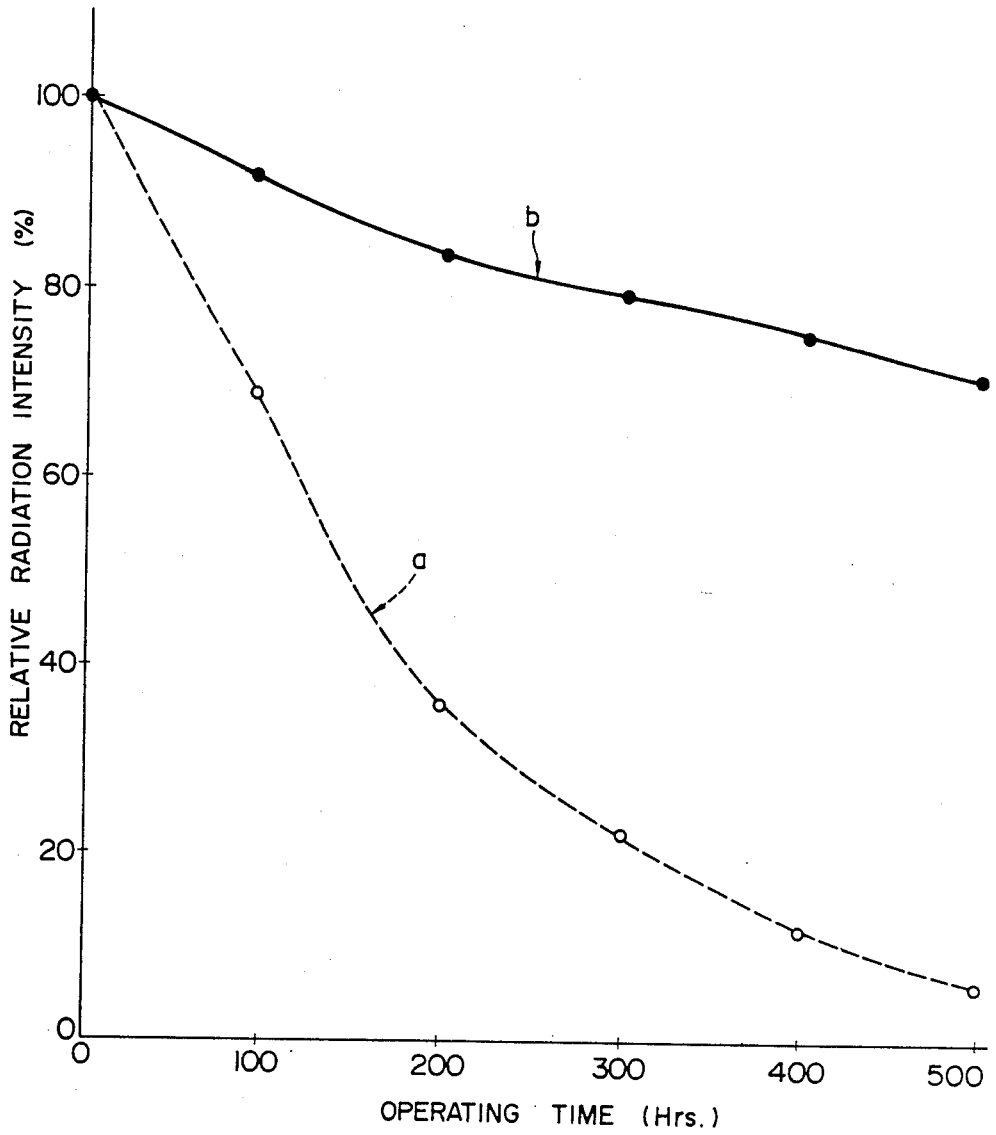
FIG. 8 is a graph wherein variations with time of the intensity of light emitted from a composite light source built in accordance with the present invention are compared with those obtained from a conventional composite light source.

FIG. 8 shows the light intensity changes with time when the device shown in FIG. 1 and the first embodiment are continuously operated at the specified rating.

Curve "b" in FIG. 8 indicates the response for the first embodiment, and curve "a" indicates that for the device of the conventional art. The light intensity from the device of the conventional device becomes one half of the initial value after the device is continuously operated for 150 hours, while the intensity of light from the device of the first embodiment decreased by a factor of 25 percent after the device of the first embodiment is continuously operated for 500 hours. The lamp built in accordance with the present invention can provide a stable light energy for a period of time longer than that obtained with the light source of the conventional device.

It should be understood that a number of modifications and variations can be made within the scope and spirit of the present invention.

What is claimed is:

1. A composite light source comprising a sealed envelope having a transparent window therein, said envelope including a longitudinal axis and being filled with deuterium gas;

an electrode structure housed within said envelope for forming an arc discharge in said deuterium gas, said electrode structure comprising a cathode;

an anode having an aperture therein; and a separation wall interposed between said cathode and said anode, said separation wall having a focusing aperture therein for focusing said arc discharge;

a tungsten lamp housed within said envelope, said tungsten lamp having a filament for emitting a light beam; and optical means housed within said envelope for focusing the light beam from said filament at the location of said focused arc discharge, the transparent window located in said sealed envelope;

the focusing aperture in said separation wall, the aperture in said anode and the filament of said tungsten lamp being arranged sequentially with their centers along a straight line, whereby light emitted from at least one of said arc discharge in said deteurium gas and from said tungsten lamp are transmitted through the transparent window in said sealed envelope.

2. A composite light source as claimed in claim 1 wherein said optical means comprises a convex lens interposed between the filament of said tungsten lamp and the aperture in said separation wall.

3. A composite light source as claimed in claim 2 wherein said convex lens comprises part of said tungsten lamp.

4. A composite light source as claimed in claim 1 which further comprises a mirror for reflecting light emitted by the filament of said tungsten lamp, said optical means being interposed between said filament and the focusing aperture in said separation plate, said mirror being located on the side of said filament opposite said optical means.

5. A composite light source as claimed in claim 1 wherein said sealed envelope is substantially cylindrical, said transparent window is made of quartz and located at one end of said envelope on said longitudinal axis, and a stem is provided at the end of said envelope opposite said window, whereby light is transmitted through said transparent window in the direction of said longitudinal axis.

6. A composite light source as claimed in claim 1 wherein said sealed envelope is substantially cylindrical, said transparent window is made of quartz and located in a side of said envelope parallel to said longitudinal axis, and a stem is provided at one end of said envelope extending transverse to said longitudinal axis, whereby light is transmitted through said transparent window in a direction perpendicular to said longitudinal axis.

* * * * *